US005602926A

United States Patent [19]

Ohashi et al.

[11] Patent Number: 5,602,926

[45] Date of Patent: Feb. 11, 1997

[54] METHOD AND APPARATUS OF DETERMINING THE SOUND TRANSFER CHARACTERISTIC OF AN ACTIVE NOISE CONTROL SYSTEM

[75] Inventors: Tadashi Ohashi; Kensaku Fujii; Juro Ohga, all of Kawasaki, Japan

[73] Assignee: Fujitsu Limited, Kawasaki, Japan

[21] Appl. No.: 115,872

[22] Filed: Sep. 3, 1993

[30] Foreign Application Priority Data

Mar. 9, 1993 [JP] Japan ..... 5-047095

[51] Int. Cl.[6] ..... G10K 11/16

[52] U.S. Cl. ..... 381/71

[58] Field of Search ..... 381/71, 94

[56] References Cited

U.S. PATENT DOCUMENTS

| | | | |
|---|---|---|---|
| 4,677,676 | 6/1987 | Eriksson | 381/71 |
| 4,736,431 | 4/1988 | Allie et al. . | |
| 5,010,576 | 4/1991 | Hill . | |
| 5,192,918 | 3/1993 | Sugiyama | 381/71 |
| 5,224,168 | 6/1993 | Martinez et al. | 381/71 |
| 5,251,262 | 10/1993 | Suzuki et al. | 381/94 |
| 5,251,263 | 10/1993 | Andrea et al. | 381/71 |
| 5,257,316 | 10/1993 | Takeyama et al. | 381/71 |
| 5,267,320 | 11/1993 | Fukumizo | 381/71 |
| 5,347,586 | 9/1994 | Hill et al. | 381/71 |

FOREIGN PATENT DOCUMENTS

| | | |
|---|---|---|
| 0043565 | 1/1982 | European Pat. Off. . |
| 0104660 | 4/1984 | European Pat. Off. . |
| 2154830 | 9/1985 | United Kingdom . |

OTHER PUBLICATIONS

Hiroshi Yasukawa,"An Acoustic Echo Canceller with Sub–Band Noise Cancelling", IEICE Trans. Fundamentals, vol. E75–A. No. 11 Nov. 1992 pp. 1516–1523.

I. Pitas et al., "Adaptive L–Filters" European Conference on Circuit Theory and Design, Sep. 1989, pp. 580–584.

Prashant P. Gandhi et al. "Design and Performance of Combination Filters for Signal Restoration", IEE Transactions on Signal Processing, vol. 39. No. 7, Jul. 1991, pp. 1524–1540.

Amlan Kundu et al. "Double–Window Hodges–Lehman (D) Filter and Hybrid D–Median Filter for Robust Image Smoothing", IEEE Transactions on Acoustics, Speech and Signal Processing, vol. 37, No. 8. Aug. 1989, pp. 1293–1989.

*Primary Examiner*—Forester W. Isen

*Attorney, Agent, or Firm*— Staas & Halsey

[57] ABSTRACT

A method and apparatus of determining the transfer characteristic in an active-noise-control system, which involves generating white noise at an end of a one-dimensional sound field that is defined by a linear ventilating system in which sound travels essentially parallel to the extended direction of the system; equalizing the transfer characteristic of the one-dimensional sound field and generating cancelling sound, according to an inverse of the transfer characteristic, to cancel the white noise and prevent noise being output from the other end of the one-dimensional sound field; continuously preventing the noise output and measuring the characteristic data of the one-dimensional sound field at, at least, one measuring point in the one-dimensional sound field; and calculating the transfer function of the one-dimensional sound field in the noise-output-prevented state, according to the characteristic data of the sound field.

19 Claims, 8 Drawing Sheets

METHOD AND APPARATUS OF DETERMINING THE SOUND TRANSFER CHARACTERISTIC OF AN ACTIVE NOISE CONTROL SYSTEM

BACKGROUND OF THE INVENTION

1. Field of the Invention

The present invention relates to a method of determining the sound transfer characteristic of an active noise control system usable with various electronic equipment such as computers.

2. Description of the Related Art

A conventional active noise control system is installed for, for example, a computer room. The computers in the computer room accommodate computer circuit boards that generate heat. The circuit boards are cooled by cooling fans. The exhaust from the fans is guided through a duct. The moving air, the cooling fans, etc., cause noise. To detect and cancel the noise, the active noise control system has a noise-detection microphone, a speaker for generating noise-cancelling sound, an error detecting microphone for detecting a cancellation error, and an adaptive filter whose parameters are controlled to minimize the output of the error detecting microphone. The sound from the speaker is propagated towards a noise-source and enters the noise detection microphone, to cause feedback sound signal. It is necessary, therefore, to provide an active noise control system that is capable of preventing such feedback.

The active noise control system having a prevention function must determine the sound-transfer characteristic in the system, to deal with the sound propagating in the exhaust duct. Since the sound transfer characteristic is dependent on the length of the duct and the operating conditions of the system, it is very difficult to correctly determine the sound transfer characteristic even using a plurality of microphones arranged in the duct, transfer characteristic estimating algorithms, or FFT (Fast Fourier Transform) analyzer. Namely, there are no conventional methods for correctly determining the sound-transfer characteristic in the active noise-control system.

SUMMARY OF THE INVENTION

The object of the present invention is to provide a method of determining the sound-transfer characteristic in an active noise-control system having a feedback sound prevention function. The method is capable of correctly calculating the sound-transfer characteristic of a one-dimensional sound field that is defined by a linear ventilating system in which sound travels essentially parallel to the extended direction of the system, for example, an inside path of a duct in an active noise-control system.

According to the invention, there is provided a method of determining a transfer characteristic in an active-noise-control system, comprises the steps of: arranging an error-detection means for detecting a noise-cancelling effect, a speaker for generating noise-cancelling sound, the detection means and a speaker being inwardly spaced by a given distance away from an end of a one-dimensional sound field that is defined by a linear Ventilating system in which sound travels essentially parallel to the extended direction of the system, a noise detection means in the vicinity of a noise source in the one-dimensional sound field, and a transfer-characteristic-detection means between the noise-detection means and the error-detection means in the one-dimensional sound field; supplying an output of the noise-detection means to an adaptive filter that causes the speaker to generate noise cancelling sound, the adaptive filter involving a filter for preventing feedback sound according to an output of the error-detection means, a filter for modeling a transfer system detection means, and a noise-cancelling filter whose parameters are continuously adjusted; and activating a transfer-characteristic determining means, through a sequencer when the noise detected by the error-detection means is minimized, to determine the transfer function of the one-dimensional sound field according to outputs of the noise-detection means and transfer-characteristic-detection means.

Further, according to the invention, there is provided a method of determining the transfer characteristic in an active-noise-control system, comprises the steps of: generating white noise at an end of a one-dimensional sound field that is defined by a linear ventilating system in which sound travels essentially parallel to the extended direction of the system; equalizing the transfer characteristic of the one-dimensional sound field and generating cancelling sound, according to an inverse of the transfer characteristic, to cancel the white noise and prevent noise being output from the other end of the one-dimensional sound field; continuously preventing the noise output and measuring the characteristic data of the one-dimensional sound field at, at least, one measuring point in the one-dimensional sound field; and calculating the transfer function of the one-dimensional sound field in the noise-output-prevented state, according to the characteristic data of the sound field.

Furthermore, according to the invention, there is provided an apparatus for estimating a transfer characteristic in an active-noise-control system, comprises: noise detection means disposed in the vicinity of a noise source, to detect white noise caused by the noise source that is disposed at an end of a one-dimensional sound field that is defined by a linear ventilating system in which sound travels essentially parallel to the extended direction of the system; error detection means spaced away from the noise source by a given distance and inwardly positioned away from an open end of the one-dimensional sound field by a given distance; a speaker disposed in the vicinity of the error detection means, to generate sound for cancelling the white noise; transfer characteristic detection means disposed between the noise detection means and the error detection means, to measure the transfer characteristic of the one-dimensional sound field; an adaptive filter whose parameters are successively adjusted according to outputs from the noise detection means and error detection means, to cause the speaker to generate the noise cancelling sound; a sequencer for starting the determination of a transfer characteristic when the cancelling sound provided by the speaker cancels the noise and the error detection means detects no noise, the sequencer maintaining the noise cancelled state until the determination is completed; and transfer characteristic determination means for determining the transfer function of the one-dimensional sound field according to outputs of the noise-detection means and transfer-characteristic-detection means, according to an instruction from the sequencer.

BRIEF DESCRIPTION OF THE DRAWINGS

The present invention will be more clearly understood from the description as set forth below with reference to the accompanying drawings, in which.

DESCRIPTION OF THE PREFERRED EMBODIMENTS

Figure 1:
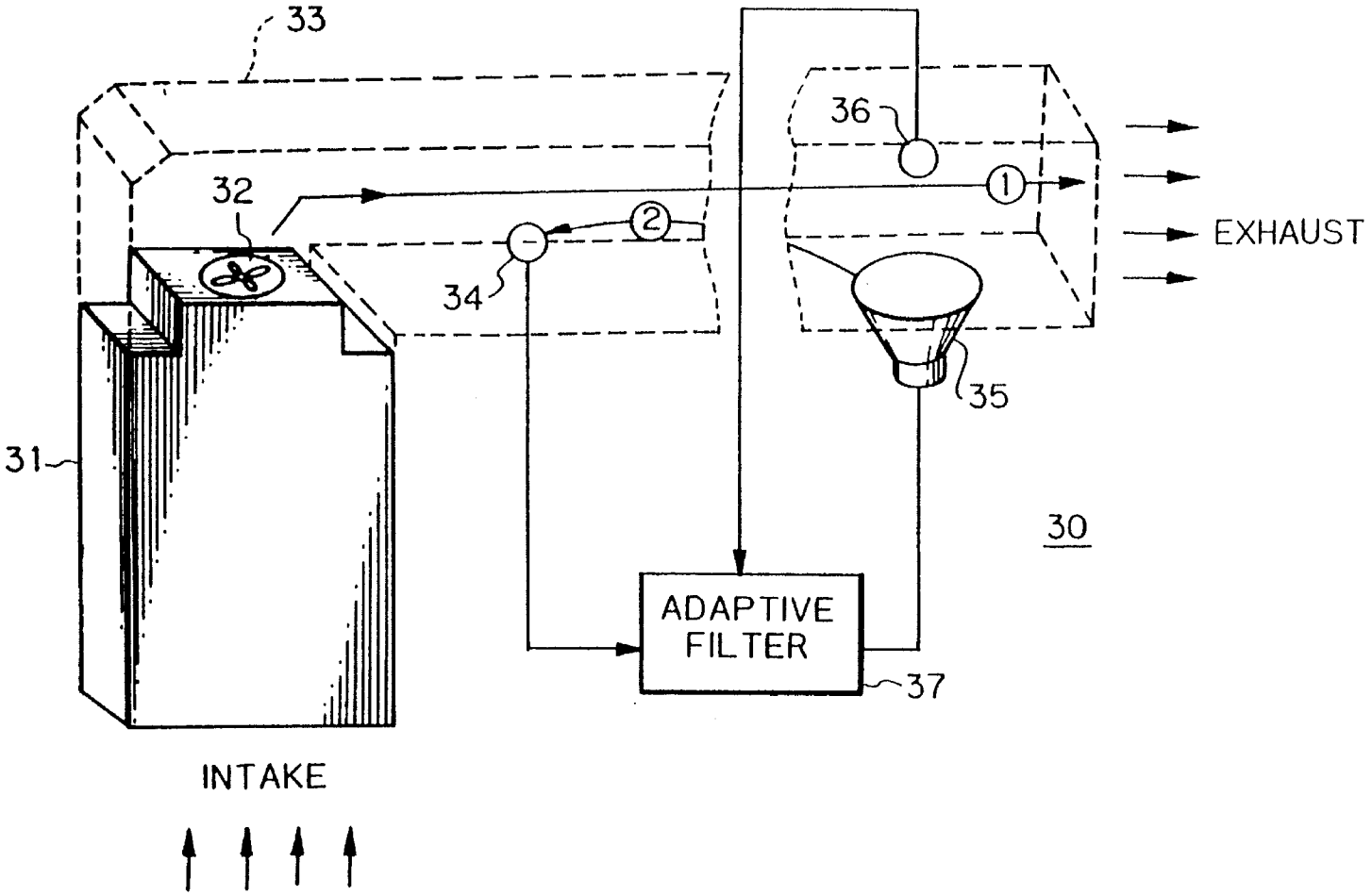
Fig. 1 PRIOR ART
FIG. 1 shows an active noise control system according to a prior art.

Before describing the preferred embodiments according to the present invention, an active noise control system of the related art will be explained with reference to FIG. 1.

The computers in a computer room 30 accommodate computer circuit boards 31 that generate heat. A cooling fan 32 cools the circuit boards 31. A duct 33 guides the exhaust air after it cools the circuit boards 31. A noise detecting microphone 34 detects the noise caused by the cooling fan 32. A speaker 35 produces sound to cancel the noise of the cooling fan 32. The output of an error detecting microphone 36 controls the parameters of an adaptive filter 37.

The cooling fan 32 generates noise ①, which passes through the duct 33 and is detected by the noise detecting microphone 34. The output of the microphone 34 is passed to the adaptive filter 37, which causes the speaker 35 to generate sound which minimizes the output of the error-detecting microphone 36. The sound from the speaker 35 then cancels the noise produced by the cooling fan 32.

Some of the sound from the speaker 35 becomes feedback sound ②, which is detected by the noise detecting microphone 34. To cancel such feedback sound, an additional filter may be added. The transfer characteristic of the feedback sound that reversely propagates the duct 33, however, changes depending on the length of the duct 33, the operating conditions of the active-noise-control system, etc., and therefore, it is very difficult to correctly determine the sound-transfer characteristic. Presently, there are no methods of correctly determining the sound transfer characteristic.

Figure 2:
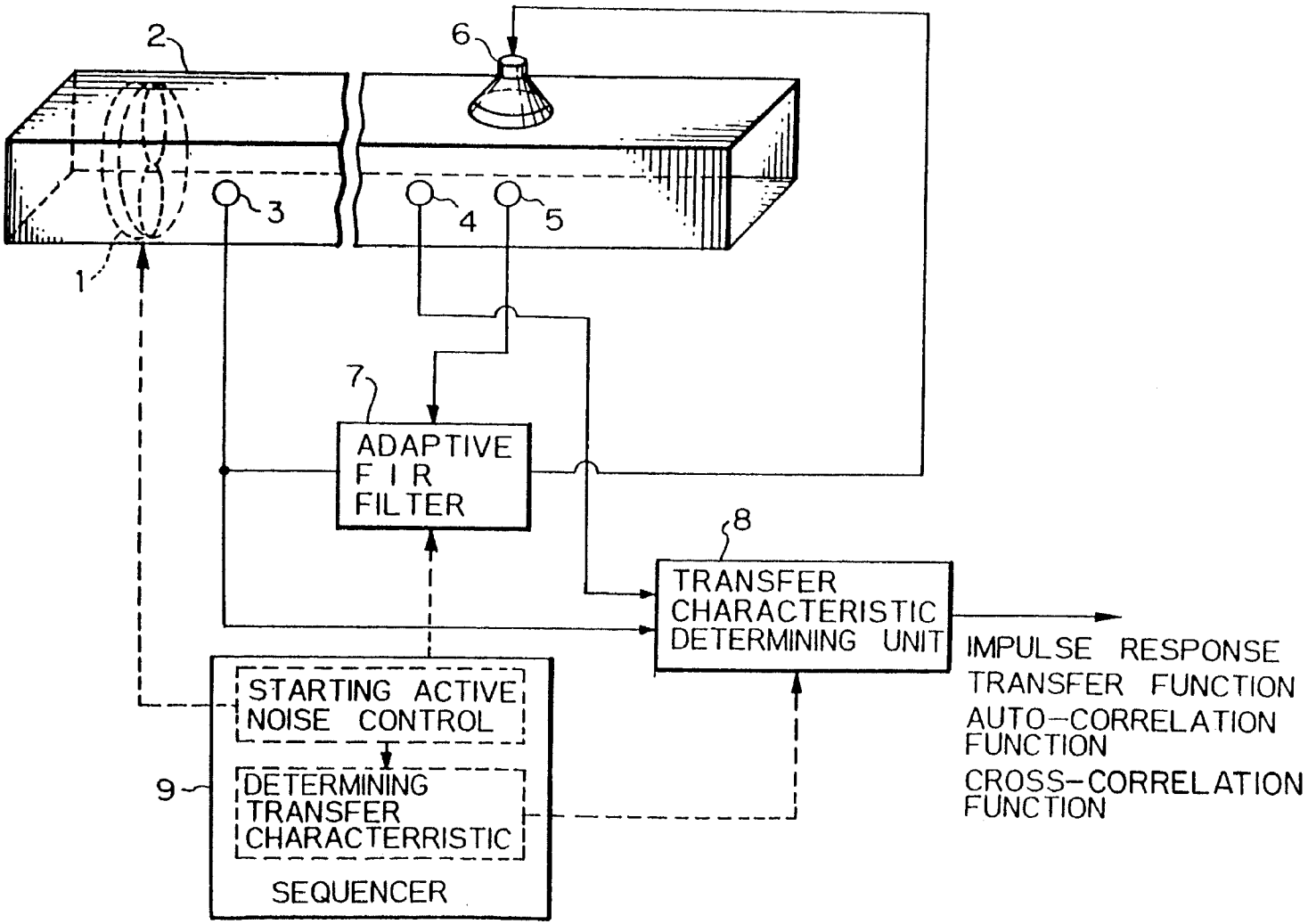
FIG. 2 shows the principle of the present invention.

FIG. 2 shows a principle of the present invention. A noise source 1 produces white noise. A duct 2 serves noise detector 3 detects the noise produced by the noise source 1. A detector 4 is a transfer-characteristic-measuring detector. An error detector 5 detects the noise-cancelling effect of sound generated by a speaker 6. An output from the detector 5 is used to adjust the parameters of an adaptive FIR (Finite Impulse Response) filter 7. A transfer-characteristic-determining unit 8 determines the transfer characteristic of the one-dimensional sound field 2 according to outputs of the noise detector 3 and transfer-characteristic-measuring detector 4. A sequencer 9 controls the timing of determining the transfer characteristic.

The error detector 5 and speaker 6 are spaced, by a given distance, from an end of the one-dimensional sound field 2. The noise detector 3 is disposed in the vicinity of the noise source 1 in the one-dimensional sound field 2. The transfer-characteristic-measuring detector 4 is arranged between the detectors 3 and 5 in the one-dimensional sound field 2.

An output from the noise detector 3 is passed to the adaptive filter 7 whose parameters are adjusted according to an output of the error detector 5. The adaptive filter 7 causes the speaker 6 to generate noise cancelling sound. When the noise is cancelled by the sound generated by the speaker 6, the sequencer 9 activates the transfer-characteristic-determining unit 8, to determine the transfer characteristic in the one-dimensional sound field 2 according to outputs from the noise detector 3 and transfer-characteristic-measuring detector 4.

When the noise source 1, controlled by the sequencer 9, generates noise, the adaptive FIR filter 7 causes the speaker 6 to generate noise cancelling sound according to the output of the noise detector 3. The error detector 5 measures the noise-cancelling effect of the sound from the speaker 6 and provides an output that adjusts the parameters of the adaptive FIR filter 7.

Once the noise is cancelled, the sequencer 9 activates the transfer-characteristic-determining unit 8. According to the outputs of the noise detector 3 and transfer-characteristic-measuring detector 4, the unit 8 determines a transfer characteristic, which may be an impulse response or a transfer function between the detectors 3 and 4, in the one-dimensional sound field 2.

In this way, the present invention determines the transfer characteristic in the one-dimensional sound field 2 after cancelling noise under active noise control. This technique correctly determines the transfer characteristic without regard to the resonance frequency determined by the operating conditions of the active noise control system and the length of the one-dimensional sound field 2.

Figure 3:
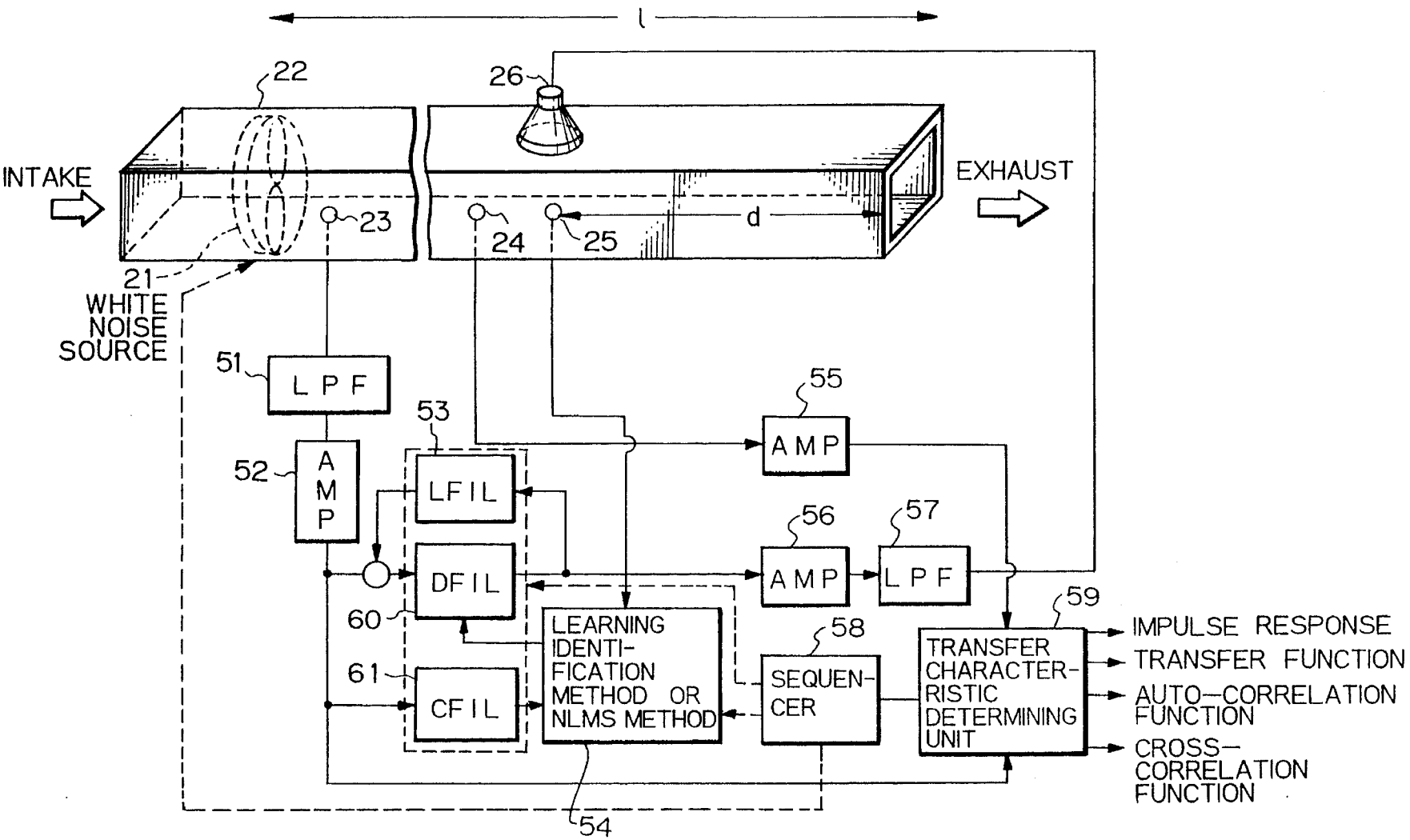
FIG. 3 shows an embodiment of the present invention.

FIG. 3 shows an embodiment of the present invention.

A noise source 21 generates white noise. The noise propagates in a duct 22. A noise-detecting microphone 23 detects the noise. A transfer-characteristic-measuring microphone 24 is used to determine the transfer characteristic of the duct 22. An error-detecting microphone 25 detects the noise cancelling effect of a speaker 26, which generates noise cancelling sound. To improve the noise cancelling effect, the speaker 26 is spaced inwardly away from an outlet of the duct 22 by a distance "d." Circuit boards and computers that produce heat are not shown.

A low-pass filter 51 removes high-frequency components from the output of the noise detecting microphone 23. An amplifier 52 converts an analog input signal from the low-pass filter 51 to a digital signal and amplifies the digital signal. An adaptive FIR filter involves an L-filter 53, a D-filter 60, and a C-filter 61. The L-filter 53 blocks feedback sound. A parameter adjuster 54 adjusts the parameters of the adaptive FIR filter according to a learning identification method or an NLMS (normalized least mean square) method. An amplifier 55 amplifies the output of the transfer-characteristic-measuring microphone 24. An amplifier 56 amplifies the output of the adaptive FIR filter and converts a digital output signal to an analog signal. A low-pass filter 57 removes high-frequency components from an output of the amplifier 56. A sequencer 58 controls the timing of estimating the transfer characteristic or the duct 22. A transfer-characteristic-determining unit 59 determines the transfer characteristic according to known transfer-characteristic-determining algorithms or fast Fourier transform analyzers. The D-filter 60 is a noise reduction filter. The C-filter 61 models a transfer characteristic from the speaker 26 to the error detecting microphone 25.

Figure 4A:
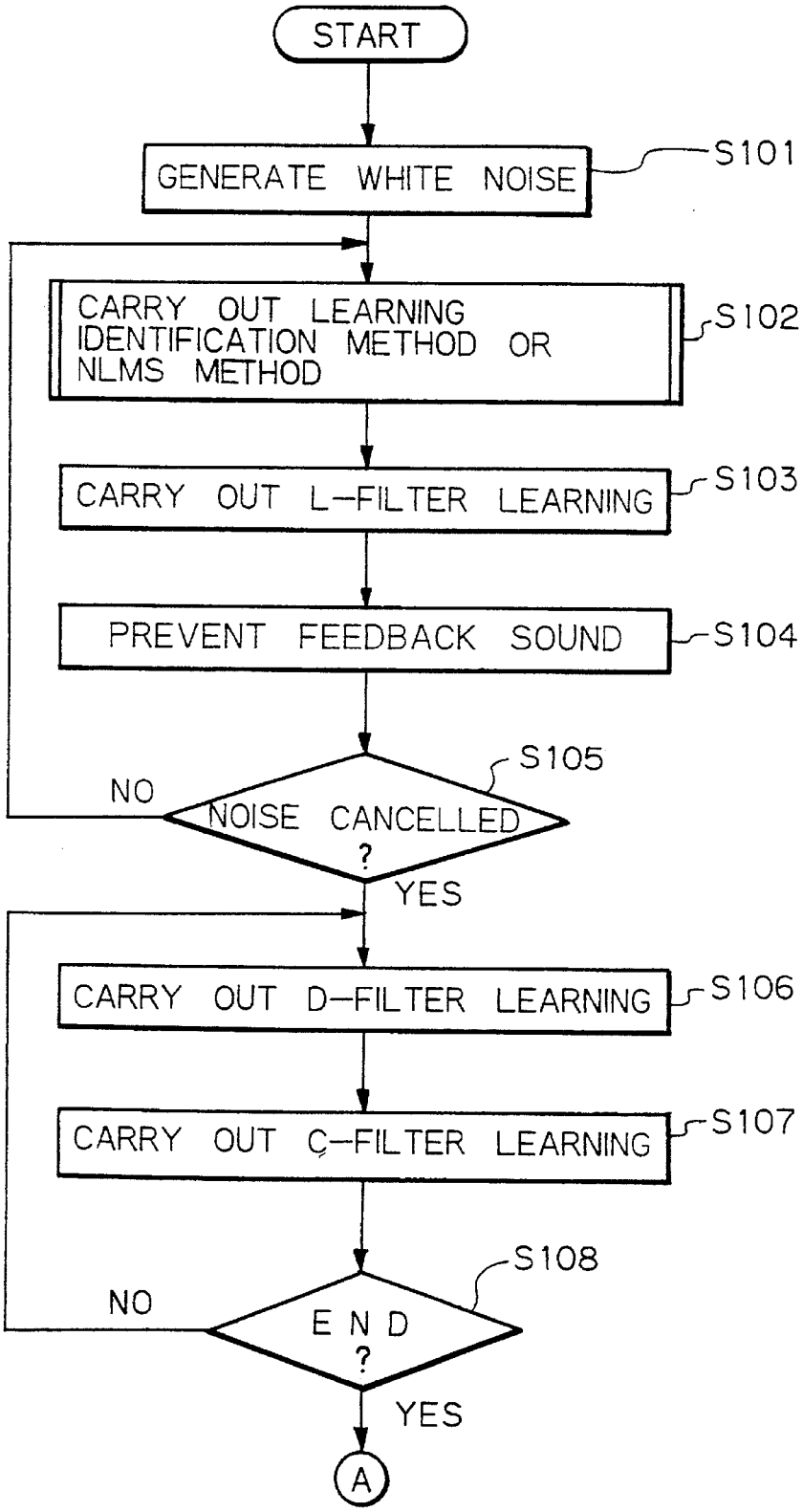
FIGS. 4(*a*) to 4(*c*) show flows (1) to (3) controlled by a sequencer, to estimate a sound transfer characteristic according to the present invention.
Figure 4B:
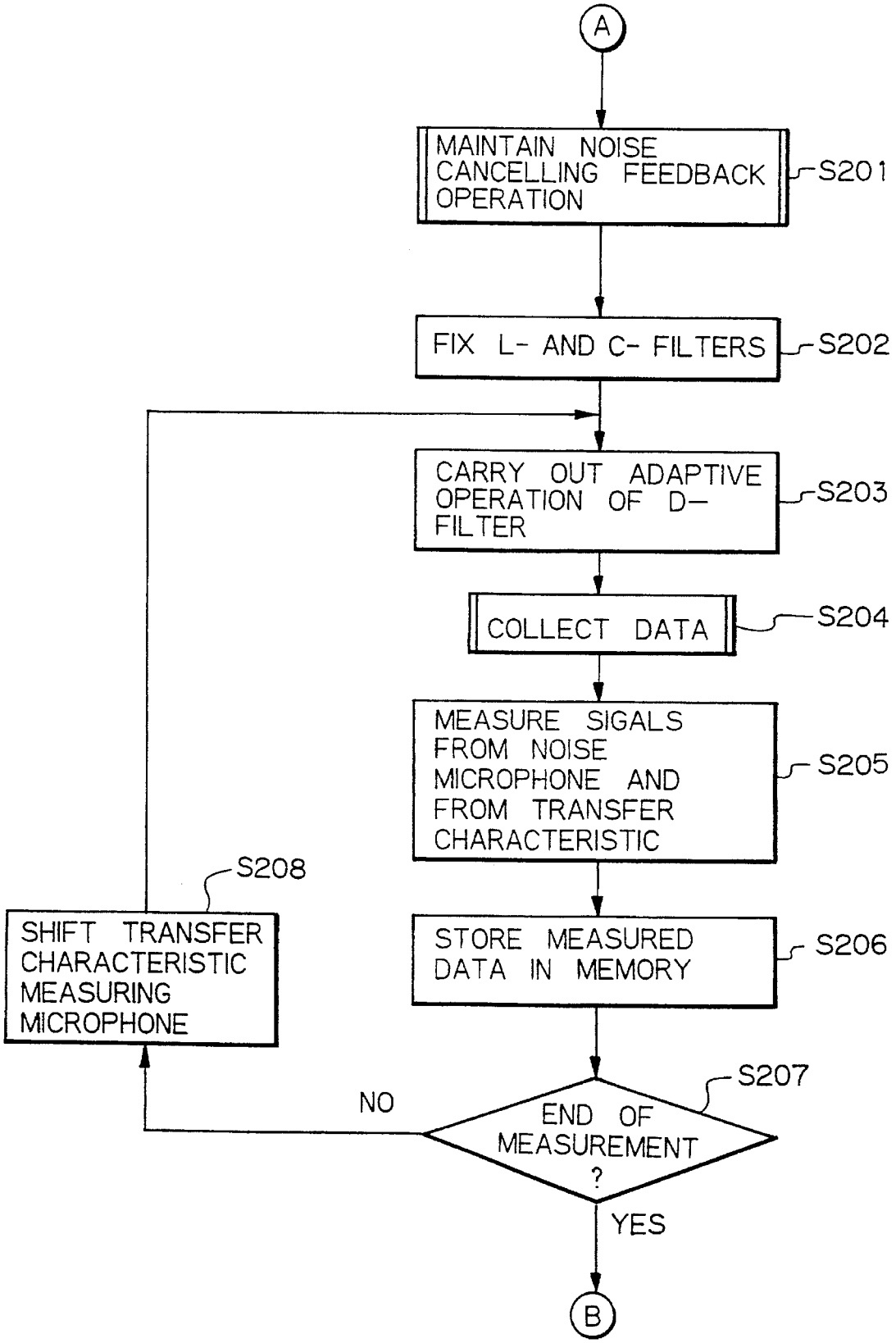
Figure 4C:
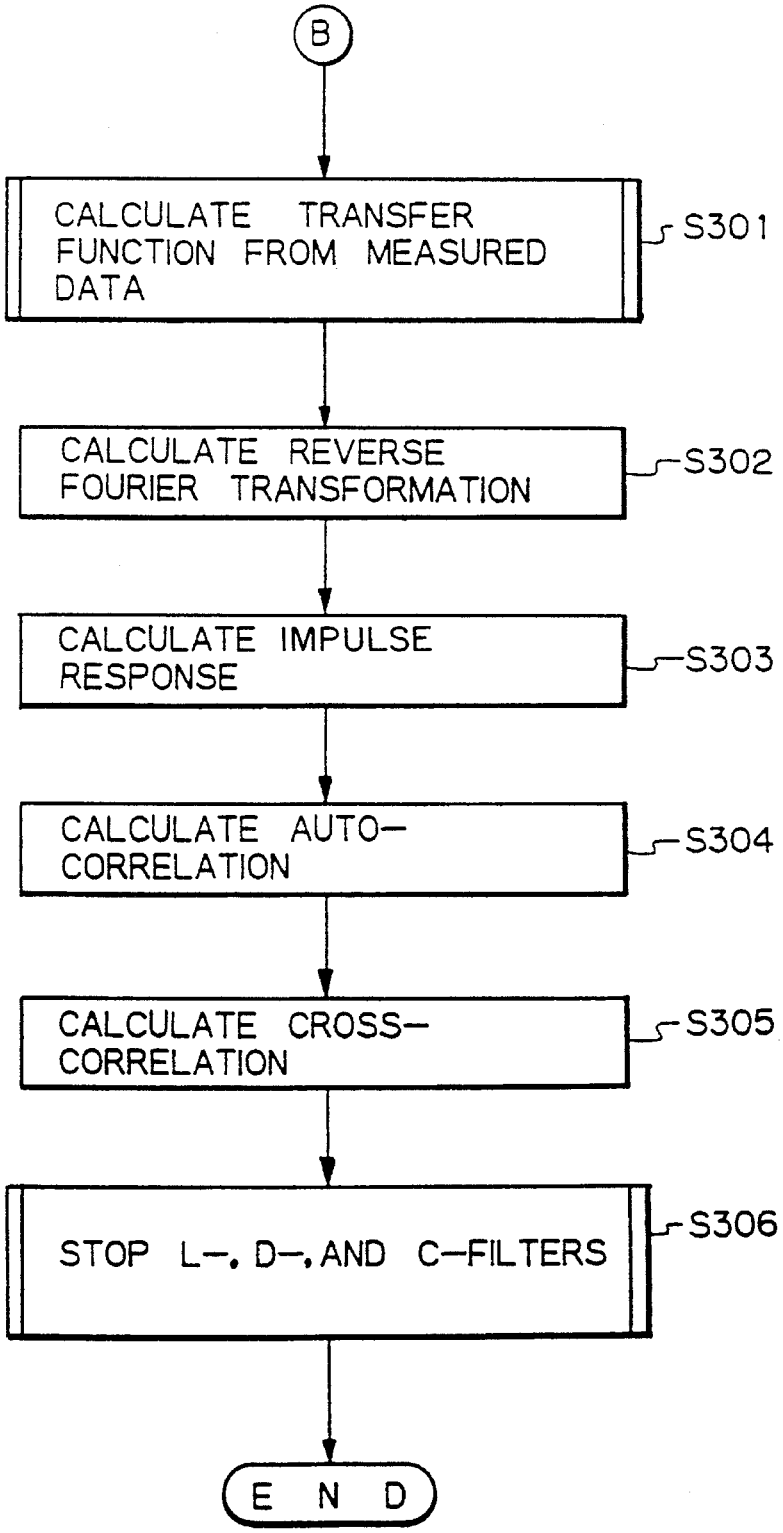
Figure 5A:
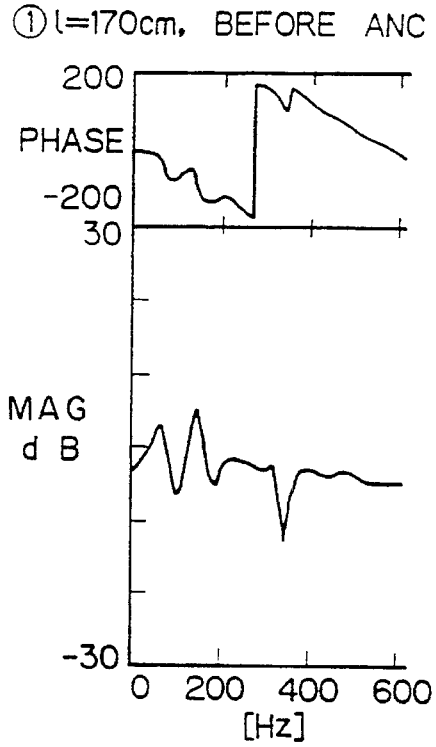
FIGS. 5(*a*) to 5(*d*) show results (1) to (4) of measurements of the frequency-gain-phase characteristics of ducts having different lengths.
Figure 5B:
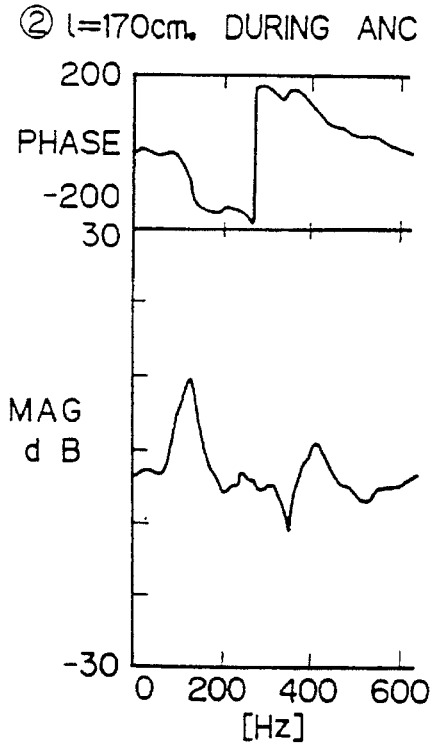
Figure 5C:
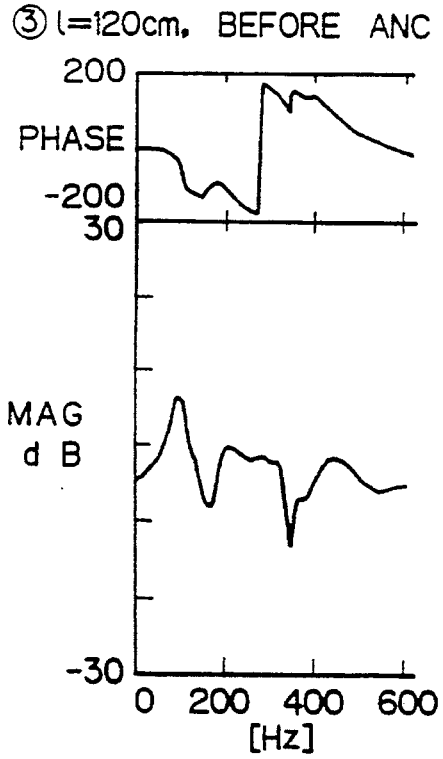
Figure 5D:
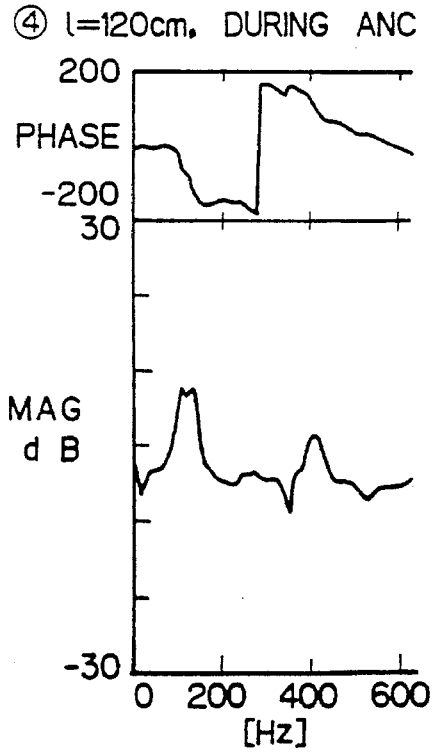

FIGS. 4(*a*) to 4(*c*) show flow diagrams illustrative of the control of the sequencer 58. The embodiment of the present invention will be explained with reference to the flow diagrams.

In step S101 of FIG. 4(*a*), the sequencer 58 causes the noise source 21 to produce white noise. The sequencer 58 drives the L-filter 53 to eliminate feedback sound through learning. Once the feedback sound is eliminated, the noise-cancelling D-filter 60 and microphone-speaker-modeling C-filter 61 are driven to cancel the white noise, through learning, in steps S102 to S108.

The output of the noise cancelling D-filter 60 is passed through the amplifier 56 and low-pass filter 57 to the speaker 26, which generates noise-cancelling sound. The error detecting microphone 25 measures the noise-cancelling effect of the sound generated by the speaker 26. The output of the microphone 25 is supplied to the parameter adjuster 54. The parameter adjuster 54 adjusts the parameters of the D-filter 60, according to the learning identification method or the NLMS method, to minimize the output of the microphone 25.

After detecting that the output of the error-detecting microphone 25 has been minimized, the sequencer 58 maintains this noise-minimized state. Namely, the parameters of the L- and C-filters are fixed at those of the noise minimized state, and the adaptive operation of the D-filter is maintained in steps S201 to S203 of FIG. 4(*b*). Step S204 collects data at a measuring point at intervals of Δt. Steps S205 and S206 sample signals from the noise-detecting microphone 23 and transfer-characteristic-measuring microphone 24 at the intervals Δt and store the sampled data in a memory. Step S208 moves the microphone 24 by a predetermined distance. The same sampling operation is carried out at the new position at time intervals Δt. Step S207 repeatedly collects data with the microphone 24 being successively moved away from the noise source 21 toward the error-detecting microphone 25.

Lastly in FIG. 4(*c*), a transfer function is obtained from the sampled data. Namely, the transfer-characteristic-estimation unit 59 determines a transfer characteristic between the noise-detecting microphone 23 and the transfer-characteristic-measuring microphone 24 according to known transfer characteristic determining algorithms or fast Fourier transform analyzers. For example, steps of FIG. 4(*c*) obtain (1) an impulse response between the microphones 23 and 24, (2) a transfer function between the microphones 23 and 24, (3) an auto-correlation function for sound detected by the microphone 23 or 24, and (4) a cross-correlation function between sounds detected by the microphones 23 and 24.

FIGS. 5(*a*) to 5(*d*) show results of measurements of standing waves, in ducts having lengths l=170 cm and l=120 cm, before and during active noise control.

If the outlet side of a duct is open, a minimum natural resonance frequency will be f=c/(21), where c is the velocity of sound in air, which is about 340 m/s at 15 degrees centigrade. According to this equation, a duct 170 cm long has a minimum natural resonance of about 100 Hz, and duct 120 cm long has a mininum natural resonance of about 142 Hz. Actually, there are disturbances and open end effects, so that the effective length will be slightly longer than the measured result.

FIGS. 5(*a*) and 5(*c*) show the frequency-gain-phase characteristics of ducts having length l=170 cm and l=120 cm, respectively, before the addition of active noise control. These figures show that the minimum natural resonance frequencies are about 63 Hz and 94 Hz, respectively, and indicate the open-end effect.

FIGS. 5(*b*) and 5(*d*) show the frequency-gain-phase characteristics of the ducts having lengths l=170 cm and l=120 cm, respectively, during active noise control. The speaker 26 is distanced away from the noise source 21 by 100 cm. Accordingly, during the active noise control, the speaker position shows a sound pressure of zero to form an apparent open end. Namely, each of the ducts has l=100 cm, irrespective of their actual lengths l=170 cm and l=120 cm. This is verified by the measurement results that show the minimum natural resonance frequencies of about 120 Hz and 130 Hz, respectively.

Figure 6:
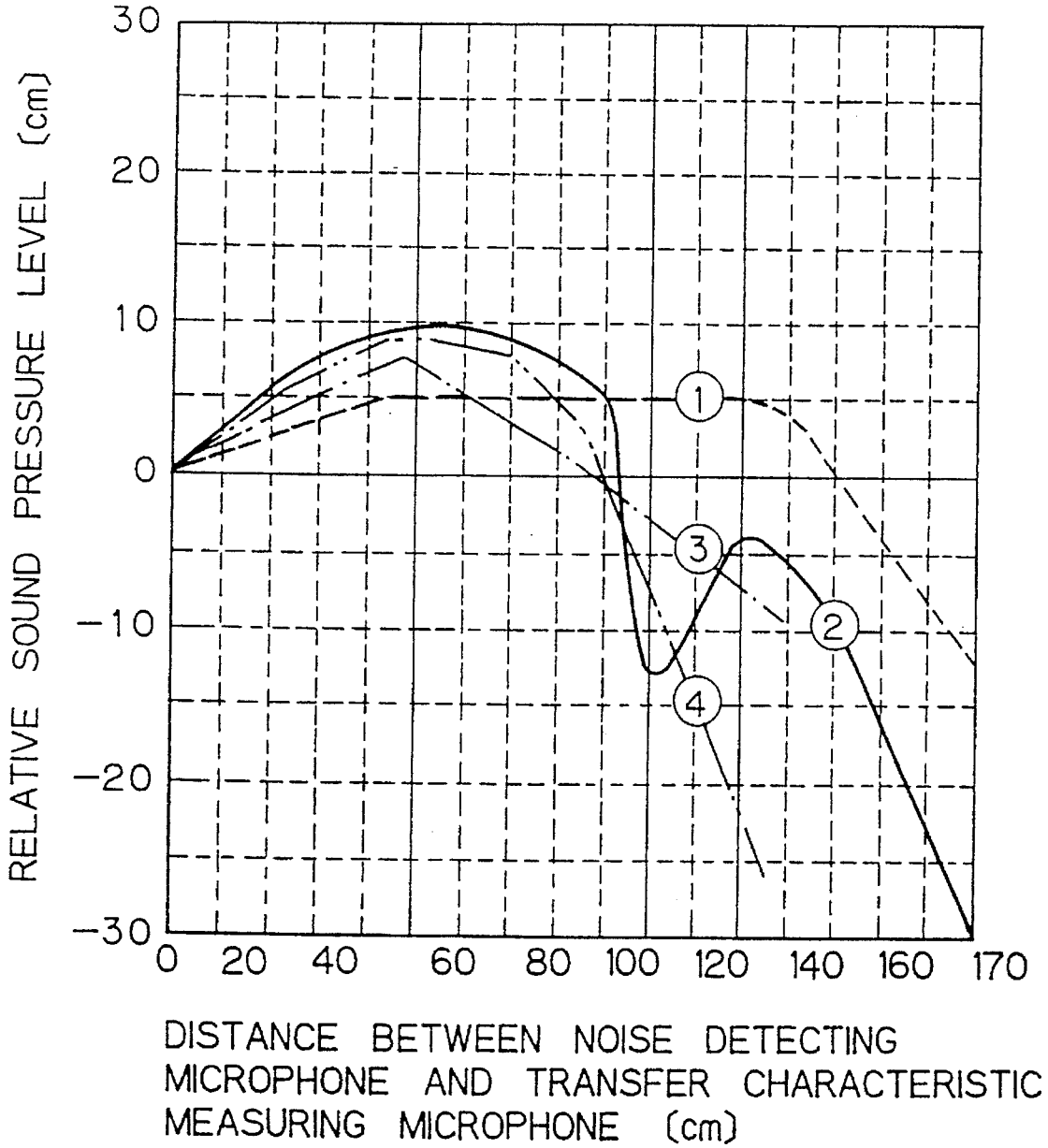
FIG. 6 shows results of measurements of standing waves of the ducts having different lengths.

FIG. 6 shows results of measurements of sound pressure distributions in the ducts of FIGS. 5(*a*) to 5(*d*) at frequencies nearly equal to the resonance frequencies with the transfer characteristic measuring microphone 24 disposed in the ducts being shifted away from the noise source 23 at intervals of 10 cm. The measurement results show that the sound pressure distributions for FIGS. 5(*b*) to 5(*d*) each having a minimum natural frequency of about 100 Hz substantially agree with one another.

As explained above, the embodiment determining transfer function in a one-dimensional sound field, such as a duct, under active noise control. Accordingly, the embodiment correctly determines the transfer characteristic without regard to the resonance frequency determined by the length of the one-dimensional sound field.

Although the embodiment determines a transfer characteristic in an electronic apparatus cooling system employing a cooling fan, the present invention is not limited to this embodiment. For example, the present invention is applicable for analyzing acoustic characteristics in various equipment such as air conditioners and electronic instruments.

In summary, the present invention cancels noise with an active noise control system and correctly determines a transfer characteristic between two points in a one-dimensional sound field without regard to the operating conditions in the active noise control system on the length of the one-dimensional sound field. The present invention is especially effective as a system that reduces feedback sound.

We claim:

1. A method of determining a transfer characteristic in an active-noise-control system, comprising the steps of:

arranging an error-detection means for detecting a noise-cancelling effect, a speaker for generating noise-cancelling sound, the detection means and a speaker being inwardly spaced by a given distance away from an end of a one-dimensional sound field that is defined by a linear ventilating system in which sound travels essentially parallel to the extended direction of the system, a noise detection means in the vicinity of a noise source in the one-dimensional sound field, and a transfer-characteristic-detection means between the noise-detection means and the error-detection means in the one-dimensional sound field;

supplying an output of the noise-detection means to an adaptive filter that causes the speaker to generate noise cancelling sound, the adaptive filter involving a filter for preventing feedback sound according to an output of the error-detection means, a filter for modeling a transfer system between the speaker and the error-detection means, and a noise-cancelling filter whose parameters are continuously adjusted; and activating a transfer-characteristic determining means, through a sequencer when the noise detected by the error-detection means is minimized, to determine the transfer function of the one-dimensional sound field according to outputs of the noise-detection means and transfer-characteristic-detection means.

2. A method of determining the transfer characteristic in an active-noise-control system, comprising the steps of:

generating white noise at an end of a one-dimensional sound field that is defined by a linear ventilating system in which sound travels essentially parallel to the extended direction of the system;

equalizing the transfer characteristic of the one-dimensional sound field and generating cancelling sound using a sound source, according to an inverse of the transfer characteristic, to cancel the white noise and prevent noise being output from the other end of the one-dimensional sound field;

continuously preventing the noise output and activating the determination of transfer characteristic data of the one-dimensional sound field at, at least, one measuring point in the one-dimensional sound field using a transfer-characteristic detector positioned before the sound source; and calculating the transfer function, using a transfer characteristic determining unit connected to the transfer-characteristic detector, of the one-dimensional sound field in the noise-output-prevented state, according to the characteristic data of the sound field, wherein an impulse response is obtained from the measured data when obtaining the transfer function to the one-dimensional sound field.

3. The method according to claim 2, wherein the transfer characteristic of the one-dimensional sound field is equalized according to a learning identification method.

4. The method according to claim 2, wherein the transfer characteristic of the one-dimensional sound field is equalized according to an NLMS method.

5. The method according to claim 2, wherein the equalization of the transfer characteristic of the one-dimensional sound field involves the teaching a feedback-sound-preventive L-filter.

6. The method according to claim 2, wherein the equalization of the transfer characteristic of the one-dimensional sound field involves the teaching a noise cancelling D-filter.

7. The method according to claim 2, wherein the equalization of the transfer characteristic of the one-dimensional sound field involves the teaching a C-filter which models a transfer system between a speaker for generating noise cancelling sound and a microphone for detecting a noise cancelling effect.

8. The method according to claim 2, wherein the noise-output-prevented state is realized by fixing the parameters of the L- and C-filters and maintaining the adaptive operation of the D-filter.

9. The method according to claim 2, wherein the characteristic data of the one-dimensional sound field include signal-level data related to a noise-output measured at an end of the one-dimensional sound field and signal-level data related to the noise output measured at, at least, one measuring point in the one-dimensional sound field.

10. The method according to claim 9, wherein the signal level data are stored in a memory.

11. The method according to claim 2, wherein the at least one measuring point is sequentially shifted by a given distance at given intervals.

12. The method according to claim 2, wherein the measured data are subjected to reverse Fourier transformation to obtain the transfer function of the one-dimensional sound field.

13. The method according to claim 2, wherein an autocorrelation function is obtained from the measured data when obtaining the transfer function of the one-dimensional sound field.

14. The method according to claim 2, wherein a cross-correlation function is obtained from the measurd data when obtaining the transfer function of the one-dimensional sound field.

15. A method of determining the transfer characteristic in an active-noise-control system, comprising the steps of:

generating white noise at an end of a one-dimensional sound field that is defined by a linear ventilating system in which sound travels essentially parallel to the extended direction of the system;

equalizing the transfer characteristic of the one-dimensional sound field and generating cancelling sound, according to an inverse of the transfer characteristic, to cancel the white noise and prevent noise being output from the other end of the one-dimensional sound field;

continuously preventing the noise output and activating the determination of transfer characteristic data of the one-dimensional sound field at, at least, one measuring point in the one-dimensional sound field; and calculating the transfer function of the one-dimensional sound field in the noise-output-prevented state, according to the characteristic data of the sound field, wherein a cross-correlation function is obtained from the measured data when obtaining the transfer function of the one-dimensional sound field.

16. An apparatus for estimating a transfer characteristic in an active-noise-control system, comprising:

noise detection means disposed in the vicinity of a noise source, to detect white noise caused by the noise source that is disposed at an end of a one-dimensional sound field that is defined by a linear ventilating system in which sound travels essentially parallel to the extended direction of the system;

error detection means spaced away from the noise source by a given distance and inwardly positioned away from an open end of the one-dimensional sound field by a given distance;

a speaker disposed in the vicinity of the error detection means, to generate sound for cancelling the white noise;

transfer characteristic detection means disposed between the noise detection means and the error detection means, to measure the transfer characteristic of the one-dimensional sound field;

an adaptive filter whose parameters are successively adjusted according to outputs from the noise detection means and error detection means, to cause the speaker to generate the noise cancelling sound;

a sequencer for starting the determination of a transfer characteristic when the cancelling sound provided by the speaker cancels the noise and the error detection means detects no noise, the sequencer maintaining the noise cancelled state until the determination is completed; and transfer characteristic determination means for determining the transfer function of the one-dimensional sound field according to outputs of the noise-detection means and transfer-characteristic-detection means, according to an instruction from the sequencer.

17. The apparatus according to claim 16, wherein the transfer-characteristic-detection means is sequentially shifted by a given distance at given intervals between the noise-detection means and the error-detection means.

18. The apparatus according to claim 16, wherein the sequencer 9 has a memory for storing the determined transfer-function data.

19. A method of determining the transfer characteristic in an active-noise-control system, comprising the steps of:

generating white noise at an end of a one-dimensional sound field that is defined by a linear ventilating system in which sound travels essentially parallel to the extended direction of the system;

equalizing the transfer characteristic of the one-dimensional sound field and generating cancelling sound, according to an inverse of the transfer characteristic, to cancel the white noise and prevent noise being output from the other end of the one-dimensional sound field;

continuously preventing the noise output and activating the determination of transfer characteristic data of the one-dimensional sound field at, at least, one measuring point in the one-dimensional sound field; and calculating the transfer function of the one-dimensional sound field in the noise-output-prevented state, according to the characteristic data of the sound field, wherein an auto-correlation function is obtained from the measured data when obtaining the transfer function of the one-dimensional sound field.

* * * * *